United States Patent [19]

Wölfinger et al.

[11] 4,121,783

[45] Oct. 24, 1978

[54] SUPPORT MEANS

[75] Inventors: Arthur Wölfinger, Wiesbaden; Klaus Nicolay, Massenheim, both of Fed. Rep. of Germany

[73] Assignee: Hoechst Aktiengesellschaft, Fed. Rep. of Germany

[21] Appl. No.: 752,991

[22] Filed: Dec. 21, 1976

[30] Foreign Application Priority Data

Dec. 22, 1975 [DE] Fed. Rep. of Germany ... 7540882[U]

[51] Int. Cl.[2] ..... B65H 19/02; B65H 75/24

[52] U.S. Cl. ..... 242/68.4; 242/73

[58] Field of Search ..... 242/68.4, 68.2, 68.1, 242/55.53, 55.3, 55.2, 129.51, 129.53, 129.5, 46.3, 68, 73, 719, 55

[56] References Cited

U.S. PATENT DOCUMENTS

| | | | |
|---|---|---|---|
| 2,514,970 | 7/1950 | Prickett | 242/68.4 |
| 2,555,885 | 6/1951 | Hope | 242/55.53 |

FOREIGN PATENT DOCUMENTS

| | | | |
|---|---|---|---|
| 178,267 | 4/1954 | Australia | 242/68.4 |

*Primary Examiner*—George F. Mautz

*Attorney, Agent, or Firm*—James E. Bryan

[57] ABSTRACT

This invention relates to a support for a roll of web material, comprising first and second support element means, means whereby the spacing between said element means is variable, said element means having opposed stop faces which in use determine the position of a roll supported between said element means, the stop face of the first element means comprising a planar surface and a member resiliently urged toward the second element means through a polygonal aperture in said surface, at least the portion of the member passing through the aperture being a frustum of a pyramid tapering in the direction of the second element means, the basal surface of which frustum is similar to and larger than the polygon of the aperture, and the stop face of the second element means tapering in the direction of the first.

16 Claims, 2 Drawing Figures

SUPPORT MEANS

This invention relates to a support means for webs wound on a core, in particular rolls of copying material rolls.

In apparatus used in the field of photoprinting, for example cutting apparatus, it is desirable that a web of copying material, which is wound on a core of, for example, cardboard, should be introduced into the machine quickly in order to reduce the down time. The web of copying material must be aligned as accurately as possible using one edge as a reference so as to be in as close as possible register with an original to be copied. Furthermore, a moment of torsion, in particular a braking torque, is to be transmitted from the receiving means to the roll so that the copying material web drawn off does not sag.

In a previously proposed support, a threaded shaft is pushed through the roll and then a flange screwed on at both ends. These flanges lie fast against the wrapped sleeve in such a manner that they can transmit a braking torque to the roll. This has the disadvantage that the insertion of a roll of copying material is relatively awkward and time-consuming.

The cores supplied by different manufacturers may have different internal diameters, and the machine must take account thereof. There also has been provided a support means which does not have a shaft passing through but has only two separate supporting elements, one on each side plate of the machine. These supporting elements are pushed from both ends into the sleeve of a roll of copying material and, self-centered, are securely clamped therein. Such a supporting element includes a supporting journal, a stop flange limiting the depth of insertion of the supporting journal into the sleeve, and a locking device, actuable from the outside, in the supporting journal, which device can be brought into engagement with an inner wall of the sleeve (German Offenlegungsschrift No. 2,331,652). The supporting journal is bowl-shaped with an inner shell and a concentric receiving bore. The locking device includes several brackets, distributed around the circumference of the supporting journal, which can be moved in and out radially be means of a retracting device. The tips of these brackets are moved out to press against the inner wall of the core roll, so that this can be radially aligned and centered whatever the internal diameter of the core.

These supporting elements are, however, relatively expensive particularly on account of the locking device. In addition, the locking of a roll of copying material on this receiving means requires at least two special manual operations so that the sleeve of the copying material roll can be locked at both ends. Locking must be carried out at both supporting elements because, if a braking torque is to be exerted only on one supporting element, one end of the copying material core will lie directly on the circumference of uniform diameter of the supporting journal. Only in the case of a particular internal diameter of the core, however, would exact radial centering, without locking, occur.

There still remains a need for a support means for rolls of web material wound, usually, on a core, suitable for use with rolls of different internal diameter, which is simple to use, and capable of holding the rolls so that moments of torsion, in particular braking torques, can be exerted thereon.

The present invention provides a support means for a roll of web material, comprising first and second support elements, the spacing between which elements is variable, the elements having opposed stop faces which in use determine the position of a roll supported between these elements, the stop face of the first element comprising a planar surface and a member resiliently urged toward the second element through a polygonal aperture in the surface, at least the portion of the member passing through the aperture being a frustum of a pyramid tapering in the direction of the second element, the basal surface of which frustum is similar to and larger than the polygon of the aperture, and the stop face of the second element tapering in the direction of the first.

Preferably the polygons are regular.

Rolls can be placed in and removed from the support means simply and quickly. In order to clamp in a new roll of copying material, it is necessary merely for the spacing between the elements to be increased to such an extent that first of all one end of the roll can be pushed onto one element and then, by closing the space, the other end can be pushed onto the other. On pushing the two elements together, the first is pushed back automatically against the force of the means exerting the resilient force, e.g. a spring. While this element is pushed back, the edges of the pyramid frustum slide in the sleeve until all lateral edges of the pyramid frustum are uniformly adjacent to the inside of the sleeve and thus to some extent press into the material of the sleeve which is often, and preferably, cardboard. As a result, the roll of copying material is forcibly radially aligned. The axial alignment is produced by the roll of copying material together with the member, being pressed, against the force of the spring, which is herein referred to as the first compression spring, against the stop surface. As the roll of copying material is thereby practically automatically aligned, it is necessary only for the two elements to be locked in position, which can be effected by locking in position a displaceable supporting arm carrying only the second element. The sleeve is radially aligned on the second element, which has a cross-section tapering towards the inside of the sleeve, in a similar manner to that in which it is aligned on the first element. For this purpose, the surface of the second element simultaneously forms an axial stop, the stop position at the second element being dependent, however, upon the internal diameter of the roll. In the case of the first element, although the stop position of the roll at the member itself depends upon the internal diameter of the wrapped sleeve, a particular alignment of the roll with the entire element at this end is achieved by means of the roll, together with the pyramid frustum being displaceable until the end face of the roll of copying material lies against the perpendicular stop face, which is normally a disc.

In accordance with the force to be applied in the centering operation, which force is a function of the compression spring pressing the member in the direction of the inside of the roll, the edges of the member are positively pressed into the roll. A torsional force can be transmitted from the element to the roll without a special locking device being required for this purpose. The line of force passes from the roll through the member and from this to the stop surface, in the opening of which the member cannot rotate because its edges are close to the opening even when it is moved a certain distance against the compression spring. That the member is, in the course of this, turned to some extent with respect to the stop surface does not matter, at least in the case where the torque braking or turning the roll with respect to the journal is always in the same direction, as is the case in photoprinting machines and similar or accessory equipment. On the other hand the support means is structurally simple and thus relatively inexpensive. This advantage is also a result of the fact that a manually operated locking device having a plurality of locking elements coupled together is not necessary. Instead of a plurality of machine elements for centering and locking, in this case only three parts are necessary, the first two being the member, displaceable through the roll under the force of the pressure spring, which effects the radial centering and the transmission of a torsional force, and the perpendicular stop face which provides the axial alignment and is also used for the transmission of the torsional force. The second member, which is usually made axially movable, forms the third part, and may in a particularly simple manner be formed in one piece tapering in the direction of the roll, the cross-section, like the cross-sections of the first journal, preferably being angular. The elements can be centered well even when the inside of the roll is not quite circular. In addition, these elements can be particularly easily removed from the roll when replacing it, because they do not have a tendency to jam.

Preferably, the basal surface of the element, which is preferably in the form of a regular pyramid frustum, is triangular. As a result the area of the aperture in the stop surface is minimized and the remaining surface area for a given diameter is particularly large. In particular, this surface extends between the vertices of the triangle close to the axis of the support means, so that even cores which are carrying only a little copying material are axially well centered.

In another variant, the basal surface of the pyramidal element is square. In this case, the stop surface between the apices of the square does not extend quite so close to the axis, but the member, however, can be produced more simply than a member with a triangular basal surface.

In any case, the conicity of the frustum may be chosen that roll internal diameters of 70 to 76 mm, which are the usual commercial dimensions, may be supported.

As already has been mentioned, the second element may be externally of identical or similar design to the first element or the member, which provides further simplification in manufacture.

Advantageously, the first support element comprises a part that acts as a housing for the first member, which part is a cylindrical housing, of which the first end wall is annular, which faces the roll, has attached thereto a stop disc forming the stop surface, and of which the second end wall, remote from the roll and the second element, has a friction lining against which a brake means, especially a brake disc, is pressed. The housing contains a compression spring with one end abutting the inner surface of the second end wall and the other end abutting the element, pressing it outwardly. The housing is rotatable, together with the element, on a first stationary axle.

Such a first support element may be made compact and reliable in operation. The path for the transmission of the brake torque from the friction lining applied to the second end wall, by way of a preferably cylindrical wall of the housing and the stop face, to the displaceable element, is short. The means is furthermore kept compact by the fact that the brake disc is pressed onto the brake lining by the force of a second compression spring positioned over and concentric with the axle, one end of the spring being in contact with the brake disc. The other end of the spring abuts on an adjusting nut, which may be moved to adjust the compression force.

The housing furthermore advantageously has an integral bearing sleeve arranged concentrically inside it for supporting it on the first axle. With this shape of the housing, the bearing sleeve provides for the support of the housing on the axle and serves as a sliding seat for the member.

Advantageously, the first compression spring is arranged concentrically around the bearing sleeve, the end of this spring that faces the member being pressed by means of a disc against the member. The position of the disc between the member and the spring is variable by means of adjusting screws extending through the sectional plane of the member.

By "sectional plane" in this case is meant the end face of the pyramid frustum that lies opposite the basal surface. By means of the adjusting screws extending through the sectional plane of the member, the force of the compression spring can be predetermined by compressing the spring to a greater or lesser extent with no roll present. The pressing force is advantageously so adjusted that the member can be pressed into the housing with the smallest possible application of force when the roll is pushed on, but that in spite of this the edges of the member can be pressed sufficiently into the roll so as to transmit brake torque. Furthermore, the travel allowed by the spring should be large enough to allow the member to be pressed in to such an extent that even the end faces of rolls of relatively small internal diameter reliably abut the stop disc. For this reason, the frustum is preferably provided with a bore on the inside to receive one end of the pressure spring.

In a variant, the friction lining may, instead of being joined to the second end wall of the housing, be joined to the brake disc.

The second element advantageously is in the form of a star-shaped cone or pyramid frustum which is rotatably mounted on a supporting arm or axle. The supporting arm may be displaced to positions closer or nearer to the first element, and locked in position on at least one guide rod radially spaced from the axles. As mentioned, the cone advantageously has the same shapes of cross-section as the member in the first element which takes the form of a pyramidal frustum.

The second element is moved on its supporting arm away from the first element when a roll of copying material is to be removed from the receiving means and, after inserting a new roll onto the first element, is returned towards it into the roll and subsequently locked in position.

To simplify the insertion of a roll of copying material, in a further advantageous embodiment of the support means there are provided, between the axles and radially spaced therefrom, curved bars to act as temporary supports for a roll.

A roll of copying material can first be laid in these bars, which are concave upwardly, while one of its ends is pressed onto the first element. Following this, the second end of the roll of copying material is then secured by pushing the second journal into the wrapped sleeve, for which this end also is lifted upwardly from the curved bars. The bars simplify the handling, in particular, of heavy and large rolls of copying material.

The ends of the bars (loops) may be attached to two guide rods which are secured, parallel to one another and to the axles, to the side plates of the support means.

One form of support means constructed in accordance with the invention will now be further illustrated with reference to the accompanying drawings, in which.

Figure 1:
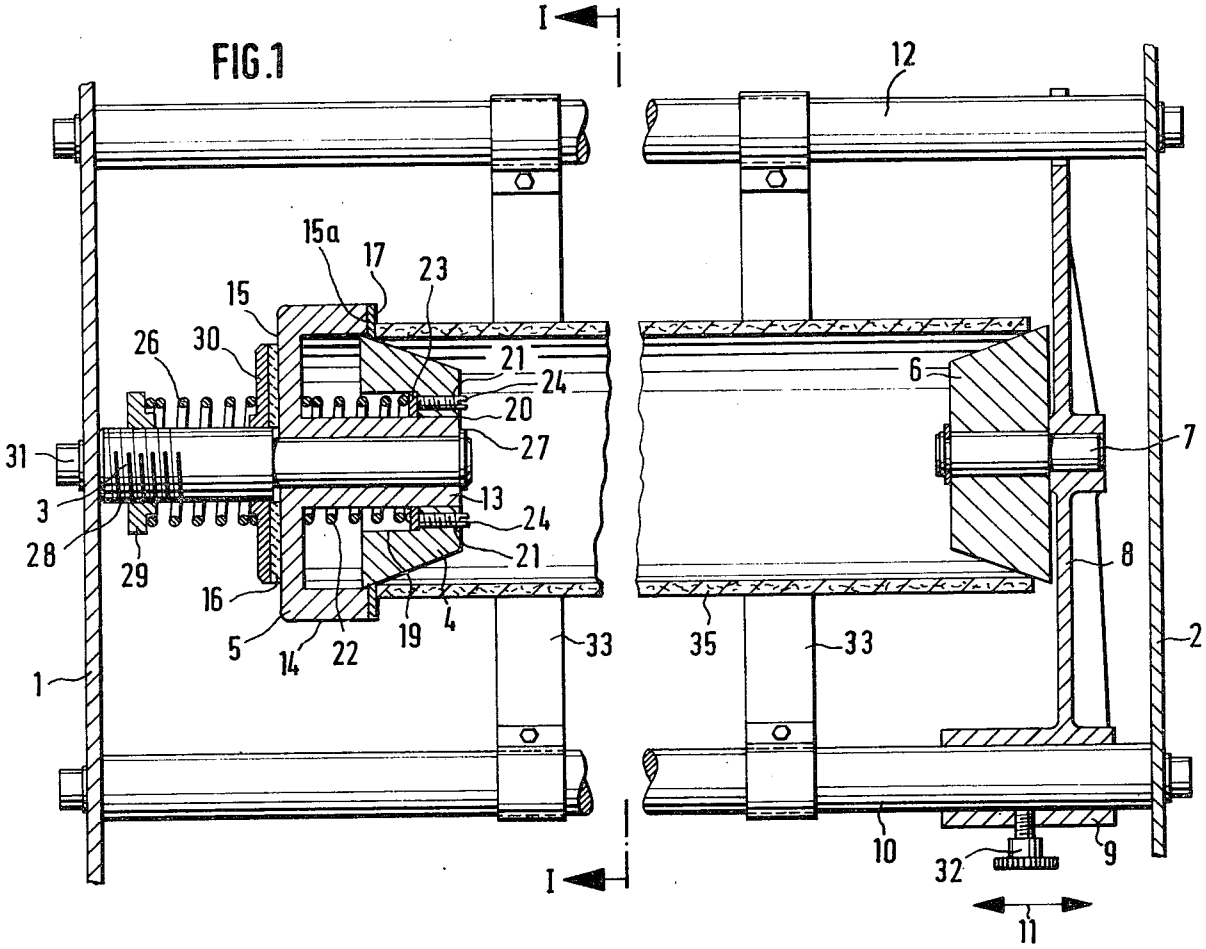
FIG. 1 shows a support means in longitudinal section.

Referring now to FIG. 1, two side plates 1 and 2 of the support means are shown; an axle 3 which extends in the direction of the side plate 2 is screwed firmly into the side plate 1, and serves at its free end, which is of reduced diameter, to rotatably mount a support element which is composed of a member 4 and a housing 5. Also shown is a second support element 6, and between the two elements there may be imagined an axis which, in use, is the axis of a roll supported by the means of the invention. The second element 6 is rotatably mounted on an axle 7 which is attached to a supporting arm 8. The supporting arm is displaceable in the axial direction but can be locked in position. For this purpose the supporting arm is carried on a tubular sliding sleeve 9, which is displaceable in the direction of the double headed arrow 11 on a guide rod 10. The guide rod 10 is parallel to a second guide rod 12, and they are both fixed between the two side plates 1 and 2. Both guide rods are radially spaced from the axis of the axles. The references to an axis do not imply that there is an axle necessarily extending between the plates 1 and 2 because the function of the means according to the invention is to dispense with such an axle. The supporting arm can be locked in position by a knurled screw 32 in the sliding sleeve 9.

In detail, the housing 5 of the first support element includes a bearing sleeve 13, which is mounted on the part of reduced diameter of the first axle 3. The first element has a cylindrical wall 14 concentric with the bearing sleeve 13. The bearing sleeve 13 and the cylindrical wall 14 are joined by an end wall 15. A friction lining 16 is fixed to the end wall. A stop disc 17 is screwed on the annular end wall 15*a*, opposite the end wall 15, to the receiving housing. (The shape of this stop disc may be seen more clearly from FIG. 2.). In particular, the stop disc has a square opening 18, the intersection of the diagonals of wich lies in the imaginary axis of the first supporting element.

The member 4 is in the form of a pyramid frustum having a square basal surface. A recess 19, which is open towards the basal surface, is provided inside the member. At the end remote from the basal surface, the recess narrows down to a bore 20. The member 4 is provided with four threaded holes 21, parallel to the bore 20 and positioned about it. The element 4 is movably mounted by the bore 20 on the bearing sleeve 13 of the housing 5.

Figure 2:
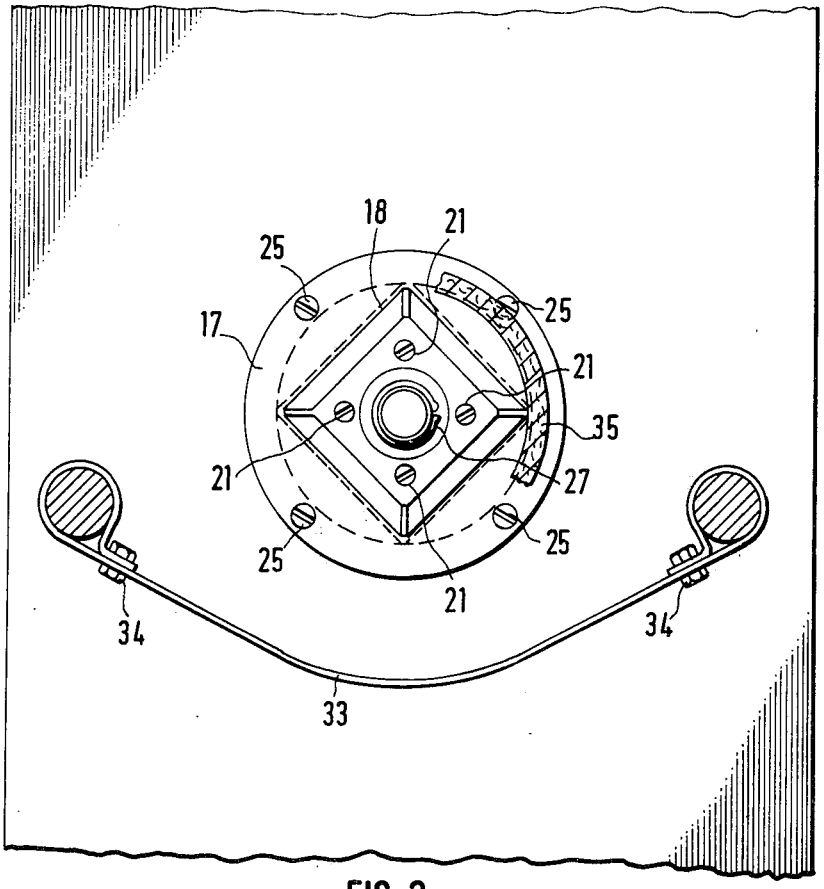
FIG. 2 shows an essential part of the means in cross-section along the line I—I in FIG. 1.

The member 4 is urged to the right, as shown in the drawing, by a first compression spring 22. The spring 22 is supported at one end against the inside of the end wall 15 of the housing and at the other end, through a disc 23, against the end of the recess 19 of the member 4. In the threaded holes 21 are the screws 24, by means of which the position of the disc 23 can be varied. As a result, the force exerted on the member 4 by the spring 22 can be varied. The member 4 is by this means pushed outwardly, or to the right, until its end faces are adjacent to the edges of the opening 18 in the stop surface 17. Since the opening 18 is similar to the basal surface of the pyramid-shaped journal and is smaller, preferably only slightly smaller, than this basal surface, the member 4 is pushed by the spring 22 against the aperture in the housing 5 or the disc 17. The stop disc 17 is secured to the housing 5 by counter-sunk head screws 25, as indicated in FIG. 2.

The housing, together with all the parts that are associated with or attached to the housing, that is, especially, the member 4, the stop disc 17 and the first compression spring 22, is pushed to the right by a second compression spring 26 until the housing is pushed up against a spring ring 27 on the axle 3. The force exerted by the second compression spring 26, which is variable so the braking torque may be adjusted, depends upon the position of an adjusting nut 29 on a thread 28. the spring 26 is supported against a brake disc 30, which is displaceable on the axle 3 but is not rotatable. The brake disc 30 is supported against the friction lining 16. The axle 3 secured against rotation is screwed to the side plate 1 by a screw 31.

Disposed below the support elements are downwardly curving or bent delivery loops or bars 33, the ends of which are looped around the guide rods and held fast by the screws 34 (See FIG. 2).

The bars 33 are provided so that the rolls of copying material which may well be 230 m long if extended and weight up to 22 kg, do not have to be held by hand when being clamped on. The bars 33 are so arranged for this purpose that the rolls of copying material can rest on one side and have only to be lifted slightly when the elements are introduced into the interior of the rolls. They are, however, so positioned that they do not rub on the copying material web of the clamped-in roll of copying material.

A roll of copying material is clamped on in such a manner that, before insertion, the right-hand element, together with the supporting arm 8, is first moved away from the first, left-hand, element to such an extent that the roll of copying material can be rested on the curved delivery loops. One end of the copying material roll is then lifted from the delivery loops and pushed onto the member 4. The opposite end of the roll of copying material is then likewise lifted, so that the second element 6 can be introduced into the roll by moving the supporting arm 8 inwardly. The second element 6, together with the roll 35 of copying material, is pushed inwardly, the member 4 moving outwardly, until an end face of the roll 35 is adjacent the stop disc 17. The position of the roll 35 in this case is shown in FIG. 1. In this position, the receiving means is locked in position by screwing tight the knurled screw 32. Copying material now can be drawn from the axially and radially aligned roll of copying material against a braking torque which is exerted, by the force of the second spring 26 by way of the brake disc 30, on the friction lining 16 at the end wall 15 of the housing 5. The braking torque is reliably transmitted by the lateral edges of the member 4 which is pressed into the roll 35.

It will be obvious to those skilled in the art that many modifications may be made within the scope of the present invention without departing from the spirit thereof, and the invention includes all such modifications.

What is claimed is:

1. A support for a roll of web material, comprising first and second support element means, means whereby the spacing between said element means is variable, said element means having opposed stop faces which in use determine the position of a roll supported between said element means, the stop face of the first element means comprising a planar surface adapted to abut on the front side of said roll and a member resiliently urged toward the second element means through a polygonal aperture in said surface, at least the portion of the member passing through the aperture being a frustum of a pyramid tapering in the direction of the second element means, the basal surface of which frustum is similar to and larger than the polygon of the aperture, and the stop face of the second element means tapering in the direction of the first.

2. A support as claimed in claim 1 wherein the polygon of the basal surface is a regular polygon.

3. A support as claimed in claim 2 wherein the polygon is an equilateral triangle or a square.

4. A support as claimed in claim 1 wherein said first element means is contained within a cylindrical housing, and comprises a first annular end wall, upon the outside of which is mounted said planar stop surface, a second end wall, remote from the second element means, on the outside of which is mounted a friction lining against which a braking surface is urged, and a cylindrical wall joining the annular end wall and the second end wall.

5. A support as claimed in claim 4 including, between the inside surface of the second end wall and the member, a first compression spring means which resiliently urges the member towards the second element means.

6. A support as claimed in claim 4 including means whereby the housing and the member are rotatably mounted on an axle.

7. A support as claimed in claim 6 wherein the housing includes an integral sleeve means positioned concentrically within it whereby it is mounted on the axle.

8. A support as claimed in claim 7 wherein the member is resiliently urged towards the second element means by the force of a first compression spring concentrically mounted about the sleeve means.

9. A support as claimed in claim 8, wherein the other end of the first compression spring abuts a disc which is affixed by means of adjustable screws to the member.

10. A support as claimed in claim 4 wherein the friction lining is attached to the brake disc.

11. A support as claimed in claim 4 including a second compression spring means mounted concentrically over the axle, whereby the braking surface and the friction lining are urged towards the second end wall.

12. A support as claimed in claim 2 wherein at least a part of the second element means is a frustum of a pyramid, and including means whereby said element means is rotatably mounted on a support arm coaxial with said first element means and with a first axle.

13. A support as claimed in claim 12 including means whereby the support arm is axially displaceable and lockable in position.

14. A support as claimed in claim 12 including curved support bar means to support a roll while the roll is being attached to the elements.

15. A support as claimed in claim 14 including means whereby the support bar means are attached to guide rods attached to end plates of the support.

16. A photocopying apparatus including a roll support as claimed in claim 1.

* * * * *